United States Patent [19]

Skarland

[11] Patent Number: 4,684,090

[45] Date of Patent: Aug. 4, 1987

[54] TRANSPORTABLE SEATING DEVICE

[76] Inventor: Henrik Skarland, St. Olavsgate 3, 0165 Oslo 1, Norway

[21] Appl. No.: 859,392

[22] Filed: May 5, 1986

[51] Int. Cl.[4] ..... A45D 19/04

[52] U.S. Cl. ..... 248/155

[58] Field of Search ..... 248/155, 155.1–155.4; 108/128, 12; 297/331; 135/66; 182/187

[56] References Cited

U.S. PATENT DOCUMENTS 731,291 6/1903 Dulin ..... 248/155.2

FOREIGN PATENT DOCUMENTS 21613 3/1883 Fed. Rep. of Germany ..... 248/155

19503 of 1907 United Kingdom ..... 248/155

*Primary Examiner*—Reinaldo P. Machado

*Assistant Examiner*—Alvin Chin-Shue

*Attorney, Agent, or Firm*—Jones, Day, Reavis & Pogue

[57] ABSTRACT

A transportable seating device is provided in a cane or walking stick by the provision of a seat rotatably mounted in the cane movable from an essentially vertical to an essentially horizontal position.

22 Claims, 5 Drawing Figures

TRANSPORTABLE SEATING DEVICE

BACKGROUND OF THE INVENTION

This invention relates generally to improvements in transportable seating devices. More specifically, it relates to improvements in seating devices that may also function as canes or walking aids.

A device known to the applicant that may serve as both a cane or walking aid and provide a surface for sitting when desired is the "English shooting stick". This device consists of a shaft having a pair of handles hinged at its upper end. A strip of canvas is attached to the handles, and when the handles are moved outwardly from the shaft, the canvas is stretched between them to provide a seat.

While the English shooting stick has served its purpose for many years, it is believed that it can be improved upon by the invention disclosed herein.

Therefore, it is an object of this invention to provide a transportable seating device which is relatively simple in construction having essentially only one moving part.

It is another object of this invention to provide a novel transportable seating device that is relatively economical to manufacture.

A further object of this invention is to provide a novel transportable seating device which is formed in such a way that it is durable, having no parts made of canvas or other fabrics subject to the wear usually attendant by the use of such material.

A still further object of this invention is to provide a novel transportable seating device which is relatively compact.

BRIEF SUMMARY OF THE INVENTION

The foregoing and other objects are achieved in one embodiment of the invention by the provision of a cane or shaft, a seat supporting arm mounted in the shaft and rotatable from a position essentially parallel to the shaft to a position approaching the perpendicular to the shaft and a seat mounted on the free end of the arm.

BRIEF DESCRIPTION OF THE DRAWING

The invention itself is set forth in claims appended hereto and forming a part of this specification, while an understanding of an embodiment thereof may be had by reference to the detailed description taken in conjunction with the drawing in which:

DETAILED DESCRIPTION

Figure 1:
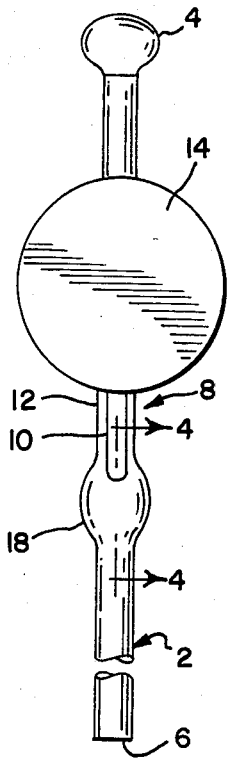
FIG. 1 is a front view of an embodiment of the invention showing the seating device in a first or folded position.

In the embodiment of the invention illustrated in the drawing, a cane or shaft 2 is provided at its upper end with a knob or handle 4 which can be used for grasping, or as will be described, for supporting a part of the body when the device is in use as a seat. A plastic or rubber tip 6 is provided on the bottom of the shaft to provide a high friction surface for contact with a floor or other surface to minimize slippage when the device is used either as a walking aid or a seat. Alternatively, a pointed end for penetrating the ground may be provided.

An arm or brace 8 is rotatably mounted in the shaft 2 at a distance from the top such that when the arm is rotated to provide a seat the person using the device is seated comfortably above a floor or other surface. For example, if the shaft 2 is 30" long then the seat should perhaps be 20" off the floor. Obviously these suggested dimensions may be changed by a designer.

Figure 2:
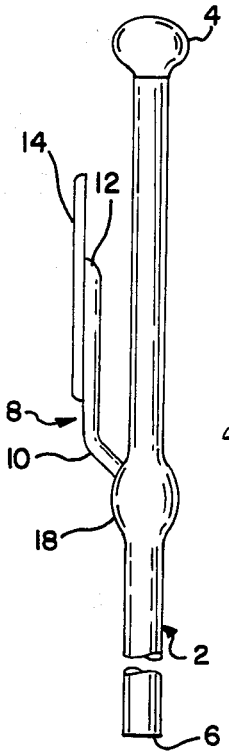
FIG. 2 is a side view of the embodiment of FIG. 1.
Figure 3:
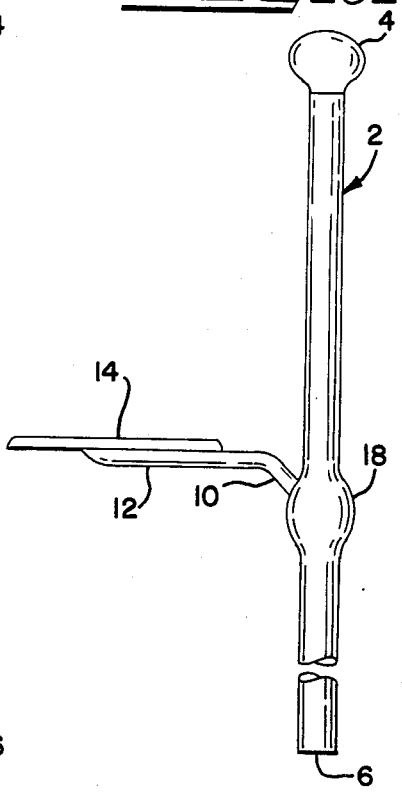
FIG. 3 is a partial side view of the embodiment of FIG. 1 showing the seating device in its second or opened position.

The arm 8 includes a first portion 10 angled upwardly to and engaging rotatably in the shaft 2. As seen in FIG. 2, the portion 10 extends outwardly from the shaft and is integral with a second portion 12 which extends generally vertical or parallel with the shaft. A seat 14 is attached to the second portion 12 by any suitable means. In the embodiment illustrated, the seat is shown as a round disc like device but it may be shaped in a number of different ways as desired by a designer.

Figure 4:
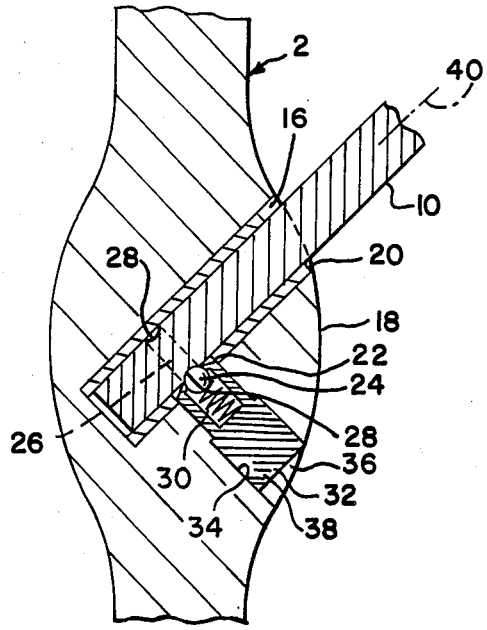
FIG. 4 is a view along the line 4—4 of FIG. 1.

As may be seen in FIG. 4 the first portion 10 of the arm is mounted in a recess 16 in an enlarged part 18 of the shaft 2. A cylindrical sleeve 20 is fitted into the recess and encompasses the portion 10 to function as a bearing. An opening 22 is provided in the sleeve 20 to permit a ball detent 24 to engage in a groove 26 formed in the portion 10 near its inner end. The groove 26 extends over approximately 180° of the periphery of the first position 10 so that as the portion 10 is rotated the ball detent 24 rides in the groove 26 but limits the rotation of that portion to about 180° as determined by the extent of the groove. Depressions 28 may be formed at opposite ends of the groove into which the ball detent 24 may be pressed to further limit rotation of the arm 8 and therefore the seat 14.

The ball detent 24 is urged into the groove 26 or one of the depressions 28 by a coil spring 30. The coil spring 30 is held in a container 32 having an opening 34 through which a portion of the surface of the ball detent 24 extends to engage in the depressions 28 and groove 26. The container 32 in turn is fixed in a recess 36 in the enlarged portion 18 by any suitable means, such as a friction fit or an adhesive, so that the coil spring at its bottom rests on a relatively fixed surface, the interior of the container, to urge the ball detent onwardly. For esthetic purposes the recess 36 may be closed by a plug 38 with its outer surface conforming to the shape of the portion 18.

This embodiment of the invention may be used as a cane or walking aid with the seat 14 in the position shown in FIGS. 1 and 2, that is, substantially parallel to the longitudinal axis of the shaft 2. When it is desired to use the invention as a seat, the seat 14 and second portion 12 and first portion 10 of the arm are rotated within the sleeve 20. As seen in FIG. 2 this may be out of the plane of the drawing. At the beginning of this rotation the ball detent 24 will be forced out of a depression 28 and ride in the groove 26 so that rotation is permitted until that detent engages in the depression 28 at the opposite end of the groove 26. Because the groove extends over about 180° of the periphery of the portion 10 the arm 8 will be rotated about the longitudinal axis 40 of the portion 10 until the portion 12 and seat 14 are in the position shown in FIG. 4, that is, in a plane substantially perpendicular to the longitudinal axis of the shaft 2. In this position the seat provides a horizontal surface on which a person may sit.

When the arm has been so rotated a person sitting on the seat 14 may rest his arm on the knob 4 and tilt the shaft 2 slightly from a perpendicular to a supporting surface so that the shaft with the individuals' legs engaging the supporting surface forms a kind of tripod providing support.

Figure 5:
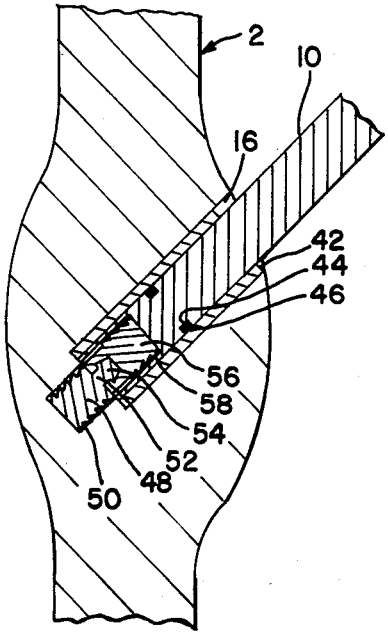
FIG. 5 is a view similar to FIG. 1 illustrating an alternative embodiment of the invention.

FIG. 5 illustrates an alternative embodiment of the invention, particularly with respect to the means which can be used to retain the arm 8 in the shaft 2. In this embodiment of the invention, those elements which are identical have been given the same reference numeral.

In FIG. 5 the portion 10 of the arm 8 extends into the opening or recess 16 in the shaft 2. The arm is rotatably mounted within a cylindrical liner 42 which may be formed of a metallic material and mounted within the recess 16. A groove 44 is formed adjacent one end of the portion 10 and an O-ring 46, formed from plastic or rubber, is positioned in the groove 44 and, bearing against the liner 42, adds increased friction so as to hold the portion 10 in any position to which it has been rotated.

To retain the arm 8 in the recess 16, a plug 48 having a tooth or serrated periphery 50 is mounted in the shaft 2 and is provided with an upper portion 52 having an enlarged head 54. Cooperating with the plug 48 is a plug 56 held in a recess in the bottom of the portion 10 by means of teeth or serrations 58. The plug 56 has an opening in its bottom generally conforming to the shape of the head 54 but dimensioned to permit rotation of the arm portion 10 about the plug 48. As may be seen in the drawing, the teeth on the plugs 48 and 56 are formed in opposite directions so as to resist their removal once inserted into their respective openings. This embodiment of the invention reduces the number of parts required to assemble the device.

Obviously, there may be numerous variations in design and dimensions. For instance, an enlarged portion 18 need not be provided but rather the shaft 2 may be thickened throughout its length and a diameter big enough to accommodate the portion 10 and the mechanism which retains it and permits its rotation. Likewise, various materials such as plastic, wood, or metal in various combinations thereof may be used.

It is intended by the claims appended hereto to cover all variations and modifications which come within their scope.

What is claimed as new and desired to be secured by Letters Patent is:

1. A transportable seating device comprising: a shaft normally oriented in an essentially vertical direction with respect to a supporting surface while in use; an arm mounted in said shaft intermediate the length thereof for rotation about the longitudinal axis of said arm; and a seat mounted on said arm and rotatable from a position substantially parallel to said shaft to a position substantially perpendicular to said shaft.

2. The seating device of claim 1 wherein said arm has a first portion rotatable in said shaft and a second portion extending substantially perpendicular to said shaft when said seat is in a seating position and said seat is mounted on said second portion.

3. The seating device of claims 1 or 2 wherein said arm has a groove extending partially around the periphery thereof and means in said shaft retaining said arm therein while permitting its rotation.

4. The seating device of claim 3 wherein said retaining means comprises a detent engaging in said groove.

5. The seating device of claim 4 wherein said detent is a spring pressed ball detent.

6. The seating device of claim 5 including a container fixed in said shaft holding said spring pressed ball detent and provided with an opening through which a portion of the ball extends to engage in said groove.

7. The seating device of claim 6 wherein said groove extends for approximately 180° around the periphery of said arm portion.

8. The seating device of claim 7 wherein depressions are provided at opposite ends of said groove for engagement by said ball detent to limit the rotation of said arm.

9. The seating device of claim 5 wherein said detent is mounted in a recess in said shaft, and means are provided to close said recess at the surface of said shaft.

10. The seating device of claim 6 wherein said container is mounted in a recess in said shaft and means are provided to close said recess at the surface of said shaft.

11. The seating device of claim 2 wherein said first portion of said arm extends from said shaft at an angle to the longitudinal axis of said shaft.

12. The seating device of claims 2 or 11 wherein said second portion of said arm extends upwardly at an angle to said first portion when said seat is in a transportable position.

13. The seating device of claim 12 including a retaining means comprising a detent engaging a portion of said arm.

14. The seating device of claim 13 wherein said detent is a spring pressed ball detent and said portion of said arm comprises a groove extending partially around the periphery of said arm.

15. The seating device of claim 14 including a container fixed in said shaft holding said spring pressed ball detent and provided with an opening through which a portion of the ball extends to engage in said groove.

16. The seating device of claim 15 wherein said groove extends for approximately 180° around the periphery of said arm portion.

17. The seating device of claim 16 wherein depressions are provided at opposite ends of said groove for engagement by said ball detent to limit the rotation of said arm.

18. The seating device of claim 17 wherein said detent is mounted in a recess in said shaft, and means are provided to close said recess at the surface of said shaft.

19. The seating device of claims 1 or 2 wherein a first retaining device is engaged within said shaft and wherein said second portion of said arm is provided with an element engaging said first retaining device to retain said arm in said shaft.

20. The seating device of claim 19 wherein said first retaining device comprises a plug mounted in said shaft and wherein said element in said second arm portion rotatably engages said plug.

21. The seating device of claim 20 wherein said plug is provided with a toothed periphery with said teeth in contact with the interior of said shaft and wherein said element is provided with a toothed periphery with said teeth engaging the interior of said second arm portion.

22. A seating device of claim 21 wherein said plug has an enlarged head and said element is provided with an opening encompassing said enlarged head.

* * * * *